United States Patent [19]

Nishikawa

[11] Patent Number: 4,615,606

[45] Date of Patent: Oct. 7, 1986

[54] APPARATUS FOR DEVELOPING ELECTROSTATIC LATENT IMAGE

[75] Inventor: Masaji Nishikawa, Hachioji, Japan

[73] Assignee: Olympus Optical Co., Ltd., Tokyo, Japan

[21] Appl. No.: 547,942

[22] Filed: Nov. 2, 1983

[30] Foreign Application Priority Data

| | | | |
|---|---|---|---|
| Dec. 17, 1982 | [JP] | Japan | 57-220144 |
| Dec. 17, 1982 | [JP] | Japan | 57-220145 |
| Dec. 20, 1982 | [JP] | Japan | 57-221798 |
| Dec. 20, 1982 | [JP] | Japan | 57-221799 |

[51] Int. Cl.[4] ..... G03G 15/00

[52] U.S. Cl. ..... 355/3 DD; 355/14 D; 118/657; 118/658; 222/DIG. 1

[58] Field of Search ..... 355/3 DD, 14 D; 118/656, 657, 658, 691; 222/DIG. 1

[56] References Cited

U.S. PATENT DOCUMENTS

| | | | |
|---|---|---|---|
| 3,152,012 | 10/1964 | Schaffert . | |
| 3,363,809 | 1/1968 | Wheeler . | |
| 3,731,146 | 5/1973 | Bettiga et al. . | |
| 4,230,070 | 10/1980 | Murasaki et al. | 118/658 |
| 4,235,194 | 11/1980 | Wada et al. | 355/3 DD |
| 4,239,374 | 12/1980 | Tatsumi et al. | 355/3 DD |
| 4,241,696 | 12/1980 | Huzii | 118/691 |
| 4,347,299 | 8/1982 | Ozawa et al. | 355/3 DD |

*Primary Examiner*—Arthur T. Grimley
*Assistant Examiner*—David Warren
*Attorney, Agent, or Firm*—Louis Weinstein

[57] ABSTRACT

An apparatus for developing an electrostatic latent image formed on a charge retaining member is provided. The apparatus includes a magnetic conveyor having a magnet roller and a non-magnetic sleeve and applies a magnetic two-component developer comprising a toner and a magnetic carrier to the latent image while it conveys the developer, thus forming a toner image. A tuft of developer carried by the non-magnetic sleeve is brought into contact with a thin uniform layer of toner formed on a toner supply roller to cause the toner to be transferred into the developer under the action of a magnetic or an electrostatic attraction.

12 Claims, 18 Drawing Figures

APPARATUS FOR DEVELOPING ELECTROSTATIC LATENT IMAGE

BACKGROUND OF THE INVENTION

The invention relates to an apparatus for developing an electrostatic latent image, and more particularly, to such apparatus which forms a toner image by applying a dry magnetic two-component developer including a magnetic carrier and a toner to an electrostatic latent image formed on a charge retaining member.

FIG. 1 shows an example of a conventional apparatus for developing an electrostatic latent image which forms a toner image by utilizing a magnetic two-component developer. In this example, a photosensitive member for electrophotography is formed by a charge retaining member including an electrostatic recording medium which is applied to the surface of a drum-shaped, conductive support (not shown). An electrostatic latent image is formed on the surface of the retaining member 1 by a technique which is known in itself. A magnet roller 2 is disposed within a cylindrical, non-magnetic sleeve 3, which is closely spaced from the charge retaining member 1, being a loose fit therein. A scraper 4 has its one end disposed in contact with the non-magnetic sleeve 3 to remove developer from the sleeve and to guide it away from the latter. An agitator blade assembly 5 is rotatably mounted at a point below the other end of the scraper 4. The sleeve 3, scraper 4 and agitator blade assembly 5 are housed with a developer housing 8, which additionally includes a doctor blade 6 disposed in a region along the lower edge which is lccated below the spacing between the sleeve 3 and the charge retaining member 1. The housing 8 is also formed with an opening in its top wall, located above the agitator blade assembly 5, for receiving a toner replenishing roller 7 in a rotatable manner. A toner hopper 9 is disposed on top of the housing 8 and receives the roller 7 in the bottom thereof.

A developing apparatus of the prior art constructed as mentioned above has exhibited a good match with existing developers, and a variety of arrangements are utilized in implementation. However, a plurality of drawbacks are found with such arrangement. Existing magnetic, two-component developer is of a reduced durability and hence has a lifetime which is less than desired, thereby requiring frequent replacement of developer. In addition, the performance of toner and carrier is less than satisfactory, and hence an adequate agitation and mixing to maintain a proper mixing ratio is necessary to assure a favorable developing effect. Furthermore, the toner tends to be scattered. To prevent the described drawbacks from occurring, a conventional developing unit which utilizes a magnetic two-component developer requires, in addition to those members such as magnet roller or non-magnetic sleeve which are directly used to effect a developing process, a developer receiving chamber of an increased size in order to avoid frequent replacement of developer or components which are used to remove developer from the sleeve 3 and to mix and agitate it uniformly with a toner which is replenished anew, thus resulting in a complex and large sized arrangement.

However, recent improvement in the technology relating to the quality of toner and carrier has greatly improved the durability of developer while simultaneously increasing the tolerance with respect to a variation in the mixing ratio of toner. It will be noted that a conventional developing apparatus is not designed for use with such improved developer, which caused problems.

Improvements relating to developer include a resin coating of carrier and the implementation of the ferrite carrier, as major improvements. The resin coating stabilizes the characteristics of a developer against variations in the environment of use thereof and also stabilizes the toner charging effect while providing a remarkably improved durability of developer. The use of the ferrite carrier achieves similar effects while it operates on the basis of a different principle. Such improvement relating to developer has increased its lifetime to a level which can be exemplified by the production of 50,000 to 100,000 copies per 500 g to 1 kg of developer. It is found that such lifetime may be excessively long for copying machines which produce a reduced number of copies monthly.

While it is contemplated that a proper lifetime may be attained for the developer by reducing the amount of developer which is loaded, it is to be noted that the design of a conventional developing apparatus is such that a developer is once removed from a sleeve for mixing and agitation, so that it is impossible to reduce the amount of developer loaded below a value which is required to enable a normal operation of such mixing and agitating mechanism. It may also be contemplated to provide a developing apparatus having reduced dimensions for various parts, but the configuration of a magnet roller cannot be simply reduced in size because of its relation to the developing performance.

As another example, FIG. 2 shows an apparatus for developing an electrostatic latent image which includes a toner mixing ratio detector 10 and a controller 11 which controls the replenishment of toner for maintaining a constant mixing ratio of toner in a magnetic, two-component developer. In this apparatus, only the toner will be consumed as a developing process proceeds, and accordingly, a toner mixing ratio in the developer is detected and a resulting signal controls the rotation of a toner replenishing roller 7 or the amount of toner replenished. The detector 10 comprises a piezoelectric vibrator connected to a diaphragm which is integral with a weir plate partly intercepting a flow of developer. The detector is mounted within the developer housing 8 at a location above the non-magnetic sleeve 3. The detector 10 produces an electrical signal indicating a change in the amplitude of the diaphragm which occurs as the amount of developer which remains stagnant on the weir plate varies in accordance with a change in the fluidity or the bulk specific gravity of developer resulting from a change in the toner mixing ratio. The signal from the detector 10 is fed through the controller 11 to cause the toner replenishing roller 7 to rotate, by actuating a motor, a clutch or the like.

As described, in conventional arrangements, it is necessary to detect a toner mixing ratio in the developer or to detect the optical density of a developed image in order to produce a control signal which is used to control the replenishment of toner. This complicates the arrangement of the developing apparatus, standing in the way of providing a developing apparatus of simple arrangement.

Another difficulty results from the usual construction of the toner replenishing roller 7. Generally, the roller 7 is provided with a groove or grooves, is knurled or is formed of sponge material so as to exhibit unevenness in its surface so that the toner is introduced into such recesses when the latter faces the toner hopper 9, and is released or caused to fall into the housing 8 by gravity or by means of a scraper (not shown) whenever such recesses have rotated to face the interior of the housing 8. Accordingly, the toner is in the form of small agglomerates when supplied, and cannot be easily dispersed into the developer in a uniform manner. This causes toner to be produced which is poorly charged, giving rise to the occurrence of a fogging over a non-image area or a scattering of toner. Furthermore, a conventional developing apparatus requires the provision of an agitator assembly of an increased size to achieve a uniform dispersion of toner replenished into the developer, and also requires that an increased amount of developer be used to produce a constant flow of developer within the apparatus.

SUMMARY OF THE INVENTION

It is an object of the invention to provide an apparatus for developing an electrostatic latent image including a non-magnetic sleeve for carrying a developer on its surface, and a toner supply roller disposed adjacent to the sleeve for supplying toner thereto, the toner on the supply roller being transferred into the developer through a tuft of developer which is formed on the non-magnetic sleeve, thereby allowing the toner to be mixed and agitated with the developer on the non-magnetic sleeve.

It is another object of the invention to provide an apparatus for developing an electrostatic latent image including a non-magnetic sleeve carrying a developer on its surface, and a toner supply roller disposed adjacent to the sleeve for supplying toner thereto, with a potential difference being applied therebetween of a level which is effective to cease the transfer of the toner from the supply roller into the developer whenever a toner mixing ratio in the developer reaches a given level, thus automatically maintaining the toner mixing ratio at a given level, without recourse to a signal from any detector means.

It is a further object of the invention to provide an apparatus for developing an electrostatic latent image including a non-magnetic sleeve for carrying a developer on its surface, a toner supply roller disposed adjacent to the sleeve for supplying a toner thereto, and a source of variable bias voltage connected therebetween which is controlled to permit the replenishment of toner into the developer to be controlled so as to maintain the performance of the developer at a given level, without recourse to the provision of any mechanical means which controls the replenishment of toner.

It is still another object of the invention to provide an apparatus for developing an electrostatic latent image including a non-magnetic sleeve carrying a developer on its surface, and a toner supply roller disposed adjacent to the sleeve for supplying a toner thereto, with means being provided which detects a developing capability of the developer to produce a signal which is used to control means which controls the contact between the toner and the developer, thus maintaining the developing capability of the developer at a given level.

In accordance with the invention, there is provided a developing apparatus of simplified construction and a reduced size and weight which affords a relatively high allowance for the accuracy of machining and assembly. With this apparatus, either a magnet roller or a sleeve or both are maintained rotating while conveying a developer carried by the sleeve, in order to allow a tuft of developer to act upon an electrostatic latent image which is formed on a charge retaining member to thereby form a toner image. A toner supply roller is disposed adjacent to the non-magnetic sleeve and carries a thin, uniform layer of charged toner, which is fed into the developer through a tuft of developer formed on the sleeve for mixing and agitation with the developer on the sleeve. This permits a developing process to be performed with a reduced amount of developer so as to take full advantage of the capability of a high performance developer.

A sealed structure may be formed between a toner hopper and the toner supply roller, thus effectively preventing any leak of toner during the movement of the developing apparatus or during the replenishment of the toner into the toner hopper.

Where a magnetic toner is employed, the use of a bias source can be dispensed with, allowing the toner on the toner supply roller to be transferred into the developer with a very simple arrangement. The application of a bias voltage across the toner supply roller and the non-magnetic sleeve permits only the toner which is normally charged to be transferred into the developer, thus effectively preventing the occurrence of fogging in the background and a scattering of toner.

In accordance with the invention, there is provided a developing apparatus comprising a non-magnetic sleeve which carries a magnetic, two-component developer thereon, a rotatable toner supply roller disposed adjacent to a tuft of developer formed on the non-magnetic sleeve for supplying toner thereto, means for forming a thin uniform toner layer on the toner supply roller while charging it, and means for developing a potential difference between the non-magnetic sleeve and the toner supply roller of a level which is effective to cease the supply of toner from the roller into the developer whenever the developer has reached a given toner mixing ratio. As a result of such arrangement, there is no need for the provision of any detector which detects a toner mixing ratio in the developer, but the toner mixing ratio can be maintained constant automatically. The replenishment of toner occurs in small increments in a very uniform manner. Since a toner which is not charged or charged poorly is not to be subject to replenishment, a uniform distribution of toner concentration within the developer is achieved, preventing the occurrence of fogging on the background or scattering of toner.

The potential difference between the sleeve and the roller can be established by utilizing a first bias source connected between the roller and the ground and a second bias source connected between the sleeve and the ground in series with a resistor of a high resistance. In this manner, the potential of the non-magnetic sleeve can be automatically changed in accordance with the toner consumption during a developing process, thus controlling the rate at which the toner is replenished so as to maintain a uniform toner mixing ratio within the developer.

Alternatively, the potential difference between the roller and the sleeve can be established by using a bias source connected to the toner supply roller while maintaining the non-magnetic sleeve in an insulated condition. Such simplified means allows a uniform toner mixing ratio to be maintained within the developer.

According to another aspect of the invention, a source of variable bias may be connected between a toner supply roller on which a thin layer of charged toner is formed and a non-magnetic sleeve which carries a developer, for establishing a potential difference therebetween. A signal from suitable means which detects a developing performance of the developer may be fed to control the source, thus controlling the replenishment of toner from the roller into the developer carried around the non-magnetic sleeve. In this manner, the replenishment of toner into the developer can be automatically achieved by controlling the source of variable bias without recourse to the provision of a mechanical control mechanism. This enhances the stability of operation, allowing a developing apparatus to be used which is simple in construction.

In the arrangement of the invention, toner on the toner supply roller which is in the form of a thin layer is previously charged, and is replenished in uniform, small increments under the influence of an electrostatic attraction exerted by the developer. Accordingly, a toner mixing ratio is uniform throughout the developer and no poorly charged toner is contained, as compared with the prior art practice in which non-charged toner may be replenished or non-uniformly replenished. In any event, the developer does not contain toner in mixture which exceeds the amount that can be carried by the carrier. This effectively prevents the occurrence of fogging over a non-image area or a scattering of toner.

It will be seen that in accordance with the invention, a thin layer of charged toner which is formed on the surface of the toner supply roller is supplied by contact with the tuft of developer carried by the non-magnetic sleeve, and such contact is controlled in accordance with a signal from means which detects the developing capability of the developer. This permits the developing capability of the developer to be maintained constant through the control of the transfer of the toner. Thus, a reduced amount of developer may be used in operation, which is advantageous for a developing apparatus of a reduced size and a simple construction which is not provided with an agitator assembly of an increased size. The toner is replenished into the developer in uniform and small increments without causing degradation of the developer, assuring the formation of an image having a uniform optical density without the occurrence of fogging over a non-image area or a scattering of toner.

Means which controls a contact between the toner and the developer may be formed by a shield plate which is detachably disposed between the roller and the sleeve, allowing the replenishment of toner to be controlled with a simple arrangement without changing the relative position of the roller and the sleeve.

Alternatively, the contact may be controlled by controlling the rotation of the toner supply roller. This assures a positive control of the toner replenishment with a simple arrangement while avoiding any complex operation of various components relative to each other.

DESCRIPTION OF EMBODIMENTS

Figure 3:
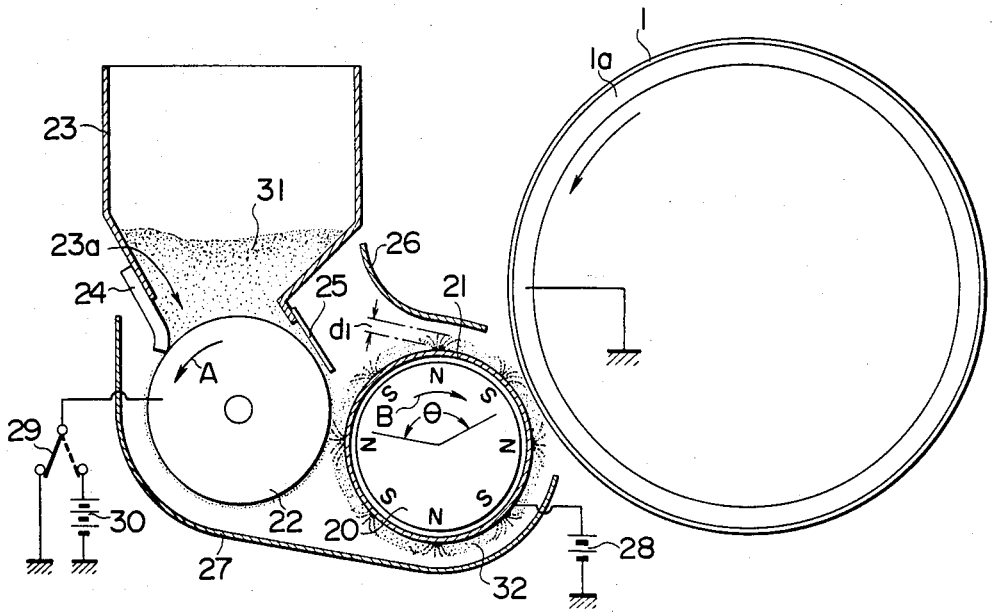
FIG. 3 is a schematic view of an apparatus for developing an electrostatic latent image according to one embodiment of the invention.
Figure 4:
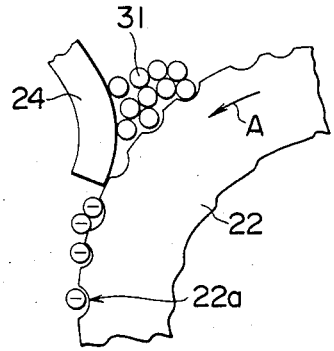
FIG. 4 is a fragmentary enlarged view of a region including a blade used in the apparatus of FIG. 3.

Referring to FIG. 3, there is shown an apparatus for developing an electrostatic latent image according to one embodiment of the invention. As shown, the apparatus includes a magnet roller 20 which is rotatably mounted and which is surrounded by and closely spaced from a cylindrical, conductive non-magnetic sleeve 21 with a small clearance therebetween. The surface of the non-magnetic sleeve 21 may be or may not be treated to be insulating. A toner supply roller 22 is rotatably disposed adjacent to and in opposing relationship with the sleeve 21, and a toner hopper 23 is disposed above the roller 22 so that a bottom opening 23*a* therein is level with the upper surface of the roller 22. The hopper 23 has tapered sidewalls adjacent its bottom, and one of the sidewalls which is advanced, as viewed in the direction of rotation of the roller 22 indicated by an arrow A, has one end of a blade 24 fixedly mounted thereon, the free end of the blade 24 being slightly bent in the same direction as the direction of rotation of the roller 22 and is disposed in contact with the roller surface. The other sidewall in the bottom region of the hopper 23 has one end of a seal plate 25 fixedly mounted thereon, the free end of the seal plate extending so as to be located opposite to the roller 22. The combination of the blade 24 and the seal plate 25 is effective to seal a clearance formed between the hopper 23 and the roller 22. Both the non-magnetic sleeve 21 and the toner supply roller 22 are surrounded by upper and lower dust covers 26, 27, with the sleeve 21 being opposed by a charge retaining member 1 through an opening defined between the covers 26, 27 and with a slight clearance between it and the retaining member.

The charge retaining member 1 is carried by a conductive support 1*a* which is connected to ground potential. The sleeve 21 is connected to the positive terminal of a source of developing bias 28 which has its negative terminal connected to the ground, whereby a positive bias voltage is applied thereto. The roller 22 is connected to a bias changeover switch 29, which may be thrown either to the ground potential or to the positive terminal of a bias source 30 which has its negative terminal connected to the ground, whereby the ground potential or a positive bias potential may be applied to the roller. In FIG. 3, numeral 31 represents toner and numeral 32 a magnetic, two-component developer carried by the sleeve 21. The thickness of the two-component developer 32 formed on the sleeve 21 is designated by $d_1$.

The developer 32 is carried by the sleeve 21 to a thickness $d_1$ under the magnetic influence of the magnet roller 20, and hence can be conveyed clockwise without dropping from the sleeve 21 as the magnet roller 20 rotates clockwise, as indicated by an arrow B. Accordingly, the amount of the developer 32 carried by the sleeve 21 represents the total amount of developer used, which is in turn determined by the diameter of the sleeve 21 and the thickness $d_1$ of the layer of developer.

It will thus be seen that in the developing apparatus of the invention, the amount of developer used can be drastically reduced as compared with the prior arrangement in which the developer 32 will be subject to a mixing and agitating action after it has been removed once from the sleeve 21. The reduced amount of developer 32 used will increase the frequency with which the developer 32 is repeatedly used and hence accelerates its degradation. However, by using a developer having an improved durability, a proper lifetime of developer 32 can be secured with a reduced amount of developer.

It will be understood that if the thickness $d_1$ of the developer 32 on the sleeve is substantially reduced, this means a rapid reduction in the total amount of developer used. Accordingly, the magnitude of the thickness $d_1$ must be chosen in consideration of the lifetime of developer. Where a thickness $d_1$ greater than 1.5 mm is chosen, to carry the developer 32 in a stable manner, it is necessary to select a carrier having increased particle diameters in combination with the consideration of the magnetic characteristic thereof. A magnetic resin carrier formed by a dispersion of magnetic powder into a resin, or a carrier having a distribution of particle diameters which are averaged to or less than 20 $\mu$ and thus close to the particle diameter of toner is less susceptible to the attraction of the magnet roller 20, rendering it difficult to carry a thickness equal to or greater than 1 mm on the sleeve 21 in a stable manner. Accordingly, where a thickness $d_1$ equal to or greater than 1.5 mm is chosen, it is preferred to choose a ferromagnetic carrier having particle diameters which are equal to or greater than 20 $\mu$.

No particular consideration is required for the choice of the toner 31, and any ordinary non-magnetic toner can be used. However, a developer comprising a combination of magnetic toner and magnetic carrier as disclosed in U.S. Pat. No. 3,345,941 or Japanese Laid-Open Patent Application No. 130,050/1982, for example, prevents the occurrence of scattering of toner 31 or fogging on a background region while increasing the tolerance against a variation in the toner mixing ratio, and thus is more preferred for use in the developing apparatus of the present embodiment.

In the developing apparatus of the present embodiment, the replenishment of toner 31 takes place through the toner supply roller 22. Since the apparatus is provided with no stirring or agitating member, toner 31 which is introduced into the developer 32 must be stirred or agitated during the time it is being conveyed around the non-magnetic sleeve 21. To produce a mixing and agitating action upon the developer 32 while it is carried on the sleeve 21, it is preferred to employ a developer conveying system of rotating magnet roller type rather than a rotating sleeve type. This is because the number of magnetic poles over which the developer passes will be relatively low in the rotating sleeve system at a given conveying rate of the developer, thus preventing a sufficient agitating effect. By contrast, with the rotating magnet roller system, the developer 32 will stretch in the form of a chain in the regions of magnetic poles, and the developer 32 is conveyed by its rolling a number of times in such regions to assure a sufficient agitating effect, which is preferred for use in the developing apparatus of the invention.

Nevertheless, it will be appreciated that such agitating effect achieved will be to a lesser degree as compared with the conventional technique in which the developer 32 is once removed from the sleeve 21 for mixing and agitation. To accommodate for this, it is desirable that the toner 31 be replenished in uniform and small increments and that pre-charged toner be supplied. The toner supply roller 22 is provided to satisfy such need. Toner 31 which is contained within the toner hopper 23 must be supplied to the roller 22 in the form of a thin, uniform layer to be charged to a given polarity which is required for the developing process.

Means which supplies pre-charged toner onto a supply roller in the form of a thin layer is disclosed in U.S. Pat. Nos. 3,363,809 and 3,731,146, either of which may be used in practising the invention.

However, the blade 24 used in the developing apparatus of FIG. 3 is slightly modified from means which are disclosed in the cited patents. The surface of the toner supply roller 22, to which the blade 24 is located opposite or in contact with must be formed as an uneven surface **22*a* having a number of minute unevenness on the order of a particle diameter of toner, for example, to a depth on the order of 10 to 50 $\mu$. The blade 24 extends from a region adjacent to the opening 23*a* formed in the hopper 23 toward the surface of the roller 22 and is held against the latter under pressure. As the roller 22 rotates in the counter-clockwise direction, as indicated by an arrow A, the toner 31 is conveyed by virtue of resistance presented by the uneven surface 22*a* formed in the roller 22, moving past the free end of the blade 24. During such process, the toner becomes charged as a result of friction with the blade 24, or becomes charged triboelectrically in the process of rotating in the uneven surface 22*a***.

The thickness of a toner layer formed on the roller 22 is governed by the surface condition and material of the supply roller 22, the material and the configuration of the free end of the blade 24 and the pressure acting therebetween. These parameters are suitably chosen so that toner particles form a single tier or two tiers. In this manner, it is a relatively simple matter to form a thin, uniform layer of charged toner 31 having a desired thickness on the toner supply roller 22.

Such roller 22 having the surface **22*a* of minute unevenness can be formed by roughening the surface of a metal such as aluminium or can be formed in the form of a rubber roller so as to exhibit a high durability. A plastic material is also applicable to form such surface. As described later, it may be necessary to apply a bias voltage to the toner supply roller 22** or to connect it to the ground potential. In such instance, it is a simple matter to provide a treatment which makes such roller electrically conductive.

Means which forms a thin layer of toner 31 on the roller 22 is not limited to that mentioned above, but alternatively a blade which utilizes a magnetic force as disclosed in Japanese Laid-Open Patent Application No. 43,037/1979 may also be used in the apparatus of the invention.

Figure 5:
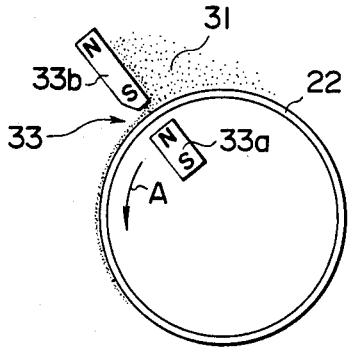
FIG. 5 is a schematic view of another form of blade means which may be used in the arrangement of FIG. 3.

FIG. 5 illustrates an arrangement which utilizes such magnetic blade in constructing the developing apparatus of the invention. In this Figure, magnetic blade means 33 comprise a pair of magnets 33*a*, 33*b*. The magnet 33*a* is disposed inside the roller 22, with its N-pole located opposite to the internal surface of the roller 22 obliquely inclined from the vertical. The other magnet 33*b* has its N-pole secured to the hopper 23 and its S-pole extends toward the outer surface of the roller 22 so as to be closely spaced therefrom. The magnets 33*a*, 33*b* are located opposite to each other on the opposite sides of the roller 22.

The magnetic blade means 33 produces a strong magnetic field, and when the roller 22 rotates through such field, a majority of toner 31 is intercepted by the blade means 33, but a single tier or two tiers of toner which remain attached to the roller surface move past the space between the magnets 33*a*, 33*b* as a result of their attraction with the roller 22 overcoming the magnetic force. As a result, a uniform, thin toner layer is formed on the roller surface.

Returning to FIG. 3, the thin toner layer formed on the roller 22 is brought into contact with the tuft of developer 32 carried by the sleeve 21 in a region where both the roller 22 and the sleeve 21 oppose each other, whereby the toner is transferred into the developer 32. The remainder of toner 31 moves past the seal plate 25 disposed opposite to the roller surface, and then returns into the hopper 23.

The seal plate 25 is formed of plastic material such as PET (polyethylene terephthalate), high polymer polyethylene, thin metal strip, rubber sheet or like elastic material, and functions to prevent the toner 31 from falling down through the opening 23*a* formed in the hopper 23. It should be noted that the seal plate 25 prevents a leakage of the toner 31 out of the hopper 23 when moving the developing apparatus with toner 31 contained within the hopper 23 or when replenishing a quantity of toner into the hopper 23, in addition to the steady-state use.

It is to be understood that the seal plate 25 presents no interference with the thin toner layer formed on the roller 22 passing thereunder while preventing a free fall of the toner 31 from the hopper 23. By extending the free end of the seal plate 25 beyond a point where it contacts the roller 22, a free passage of the toner 31 attaching to the roller 22 is permitted without causing a scraping off thereof.

A transfer of the toner 31 from the roller 22 into the developer 32 can be effected under the influence of a magnetic force if magnetic powder is contained within the toner 31, thus greatly simplifying the construction of the apparatus. However, if the amount of magnetic powder contained in the toner 31 is minimized in order to prepare a colored toner or to prevent disturbances in the developing performance which might be caused by containing an excessive amount of magnetic powder, a transfer of the toner 31 principally takes place under the influence of an electrostatic attraction which is produced by the application of a bias voltage across the sleeve 21 and the roller 22.

It is to be noted that in the apparatus shown in FIG. 3, the conductive support 1*a* which carries the charge retaining member 1 is connected to the ground, and thus it is assumed that an electrostatic latent image is formed by a positive charge.

The non-magnetic sleeve 21 which is electrically conductive is formed by aluminium, stainless steel or the like, and is supplied with a positive bias voltage from the source 28 in order to prevent the occurrence of fogging over a background area or to produce an image of a desired optical density. The application of a bias voltage to the non-magnetic sleeve 21 during the developing step is conventional, and any desired magnitude of such bias voltage can generally be chosen to permit the occurrence of fogging over a background area to be effectively prevented or to obtain any desired optical density of the image.

A voltage of lower magnitude than that applied to the sleeve 21 is applied to the toner supply roller 22. When the switch 29 shown in FIG. 3 is thrown to its solid line position to connect the roller 22 to the ground, the roller 22 will be maintained at a potential less than that of the sleeve 21. If it is desired to maintain the sleeve 21 at the ground potential, a negative bias voltage is applied to the roller 22. When the switch 29 is thrown to its broken line position, a high bias voltage is supplied from the source 30 to the roller 22, preventing the replenishment of toner 31 into the developer 32.

When developing an electrostatic latent image of a positive polarity, toner 31 which forms the developer 32 is charged to the negative polarity while the carrier is charged to the positive polarity. Accordingly, the toner 31 which is maintained on the roller 22 must be charged to the negative polarity. The toner 31 charged to the negative polarity is transferred from the roller 22 into the developer 32 in the region of a tuft of the latter under the influence of an electric field developed across the carrier within the developer 32 and the roller 22 and acting to attract the toner 31 toward the carrier. It will be appreciated that those fractions of the toner 31 which are poorly charged are not subject to such attraction and hence do not undergo migration into the developer 32 from the roller 22, allowing only the toner 31 which is normally charged to be transferred into the developer 32. By adjusting the potential difference between the roller 22 and the sleeve 21, it is possible to choose suitably a threshold level for the charged potential of the toner 31 which can be transferred into the developer 32. Specifically, the higher the potential difference across the roller 22 and the sleeve 21, the less the degree may be to which the toner 31 must be charged in order for it to be transferred into the developer 32. By lowering the potential difference therebetween, an arrangement can be made to allow only that fraction of toner 31 which is strongly charged to be preferentially transferred into the developer 32.

When an agitating effect of the developer takes place only on the sleeve surface as in the developing apparatus of the invention, toner which is poorly charged or which is not charged reaches a developing station opposite to a charge retaining member before it is sufficiently stirred, and thus the occurrence of fogging over a background area or a scattering of toner may be caused. However, in the developing apparatus of the embodiment, a toner which is poorly charged can be prevented from being introduced into the developer by an adjustment of the potential difference between the toner supply roller and the sleeve, thereby avoiding the difficulty such as the occurrence of fogging.

Figure 1:
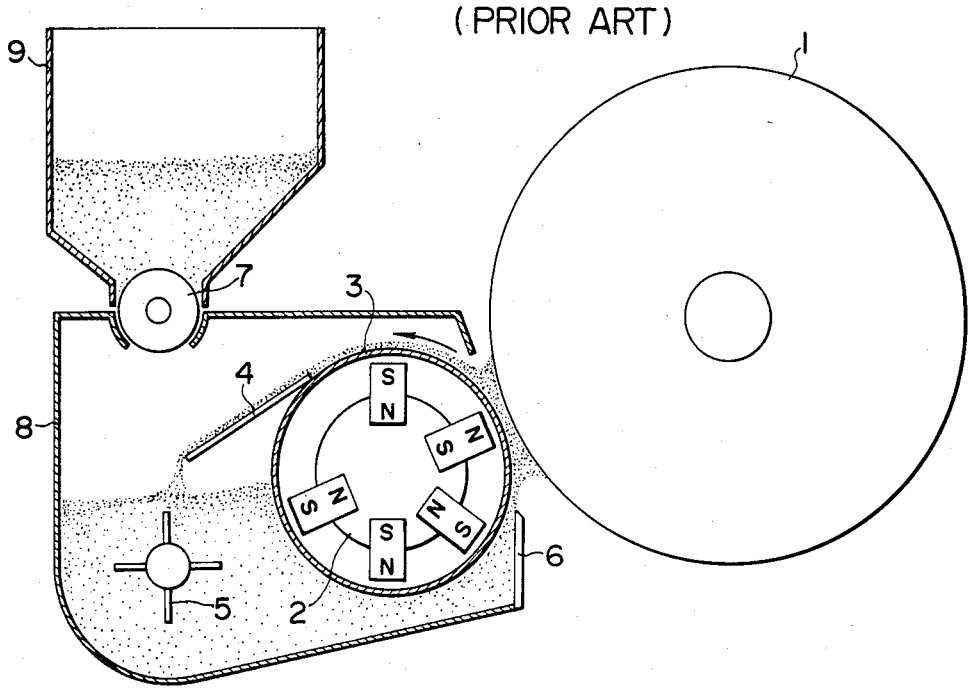
FIG. 1 (PRIOR ART)
FIGS. 1 and 2 are schematic views illustrating examples of conventional apparatus for developing an electrostatic latent image.
Figure 2:
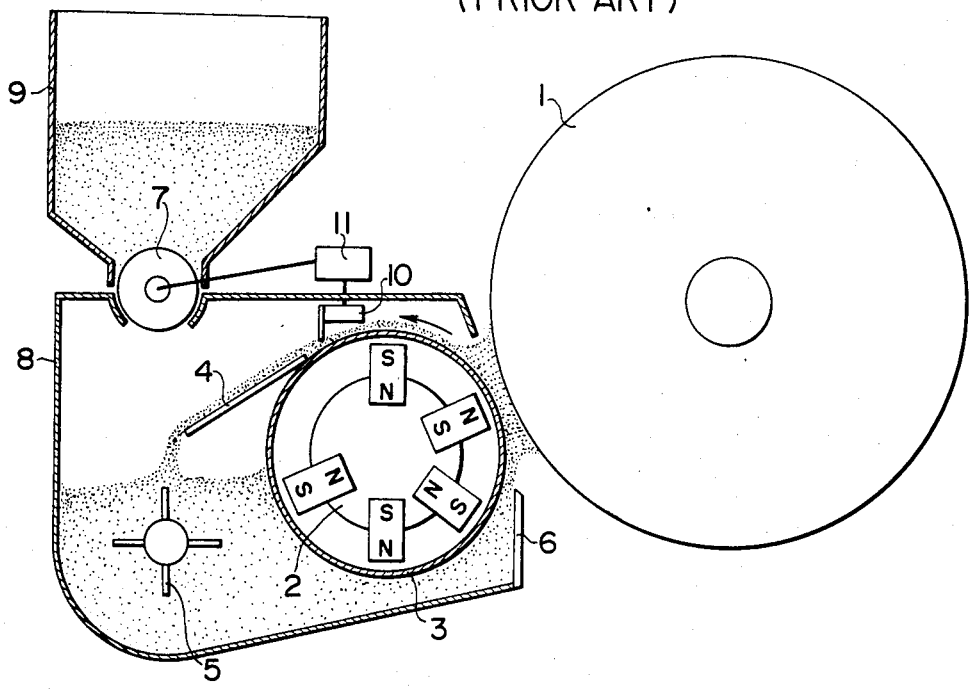
FIG. 2 (PRIOR ART)

It will be noted that in a conventional apparatus as illustrated in FIGS. 1 and 2, toner is replenished into a developer while the toner remains uncharged. Accordingly, there exists uncharged toner or agglomerations of toner. In extreme instances, a toner may be supplied in an amount which exceeds the maximum that can be carried by the carrier, and as a result, there is no assurance that all of the toner is adsorbed by the carrier. By contrast, in the developing apparatus of the embodiment, the replenishment of the toner into the developer takes place through the toner supply roller, and in this process, the toner must be adsorbed by the carrier in order for it to be transferred into the developer. This means that there can be little or no toner present within the developer, in principle, which is not carried by the carrier, thus effectively preventing the occurrence of fogging over a background area or scattering of the toner.

It is to be noted that the developing apparatus of the present embodiment operates based on a distinct principle from an impression developing apparatus as disclosed in U.S. Pat. No. 3,152,012 in that the replenished toner is subject to mixing and agitation as the developer is conveyed around the sleeve and that the developer forms a layer having a thickness of $d_1$, and contains an amount of toner which is far greater than the amount of toner that is consumed during a single developing process, and consequently, provides a significant advantage over such prior apparatus.

Additionally, in the developing apparatus of the embodiment, the toner replenished is not completely consumed during every developing process, but is consumed after a plurality of developing processes, thus allowing an advantage to be taken of a two-component developer comprising a magnetic carrier and a toner. By way of example, assuming that a developer in an amount on the order of several tens to several hundreds of grams is maintained on the sleeve 21, and the developer has a toner mixing ratio in a range from 5 to 10%, the amount of toner that is contained within the developer can be estimated to be on the order of 2 to 15 grams, which amount is sufficient to provide 100 to 750 copies having a size of 210 mm×300 mm and having a black area of 5%. If the actual total amount of developer on the sleeve is as small as several tens of grams, the developer utilizes a carrier having reduced particle diameters, and hence the toner mixing ratio can be increased as high as several tens of percents so that the total amount of toner contained within the developer can be increased to twice or thrice the value given above.

In the developing apparatus of the embodiment, it is preferred that the toner which is supplied from the roller 22 be subject to sufficient mixing and agitation before it is used in developing a latent image. To this end, it is desirable to increase an angle $\theta$ defined by an arc between a point on the sleeve 21 where the toner is supplied and another point thereon which is located opposite to the charge retaining member 1, with respect to the center of the magnet roller 20. It is preferred that this angle $\theta$ be equal to or greater than 90° for the purpose of mixing and agitation. Since the force of gravity is not utilized to replenish the toner, the toner can be replenished at any point on the sleeve. In an extreme case, the toner may be replenished at the lowest point on the sleeve 21, thus affording a greater freedom of design, which represents one of advantages of the present embodiment.

In the embodiment described above, only the magnet roller 20 has been subject to rotation. Alternatively, the sleeve 21 may be rotated in the opposite direction to the direction in which the toner is conveyed, thereby increasing the chances of agitating the developer for a given distance over which the developer is conveyed. Where a high performance developer including a carrier which has an improved capability to retain the toner and exhibiting a developing performance which is less subject to variation in response to a change in the toner mixing ratio is used, the magnet roller 20 may be fixed while the sleeve 21 may be rotated to convey the developer.

Figure 6:
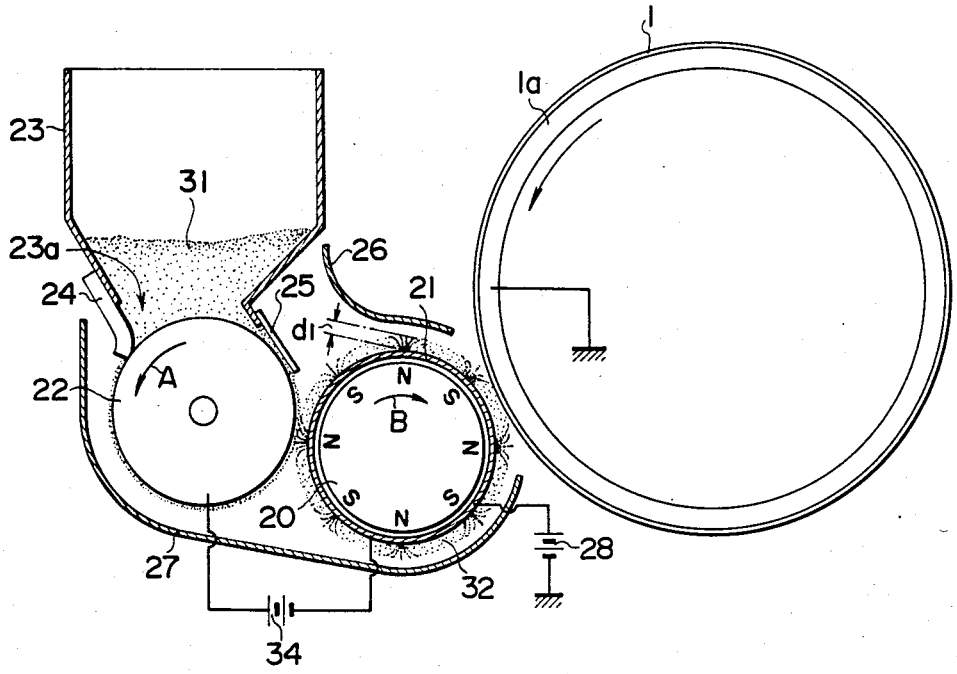
FIG. 6 is a schematic view of an apparatus for developing an electrostatic latent image according to another embodiment of the invention.

FIG. 6 shows another embodiment of the invention. An apparatus for developing an electrostatic latent image of this embodiment is similar to that shown in FIG. 3 except that a source of bias voltage 34 has its positive terminal connected to the toner supply roller 22 and its negative terminal connected to the non-magnetic sleeve 21, in contradistinction to the arrangement of FIG. 3 in which the roller 22 is connected through the changeover switch 29 to either the ground or the positive terminal of the bias source 30 which has its negative terminal connected to the ground. In other respects, the arrangement is similar to that shown in FIG. 3, and hence corresponding parts are designated by like reference characters without repeating their description.

Again in this embodiment, the principle of transferring the toner 31 into the developer 32 is based on electrostatic attraction. Thus, the migration of the toner 31 is determined by an electric field established between the roller 22 and the sleeve 21. In the present embodiment in which the toner 31 is charged to the negative polarity, the toner 31 can be transferred into the developer 32 on the sleeve 21 if the roller 22 is maintained at a negative potential or a less positive potential with respect to the sleeve 21. On the contrary, if the roller 22 is maintained at a higher positive potential, the toner 31 cannot be removed from the roller 22 and hence cannot be replenished into the developer 32.

Figure 7:
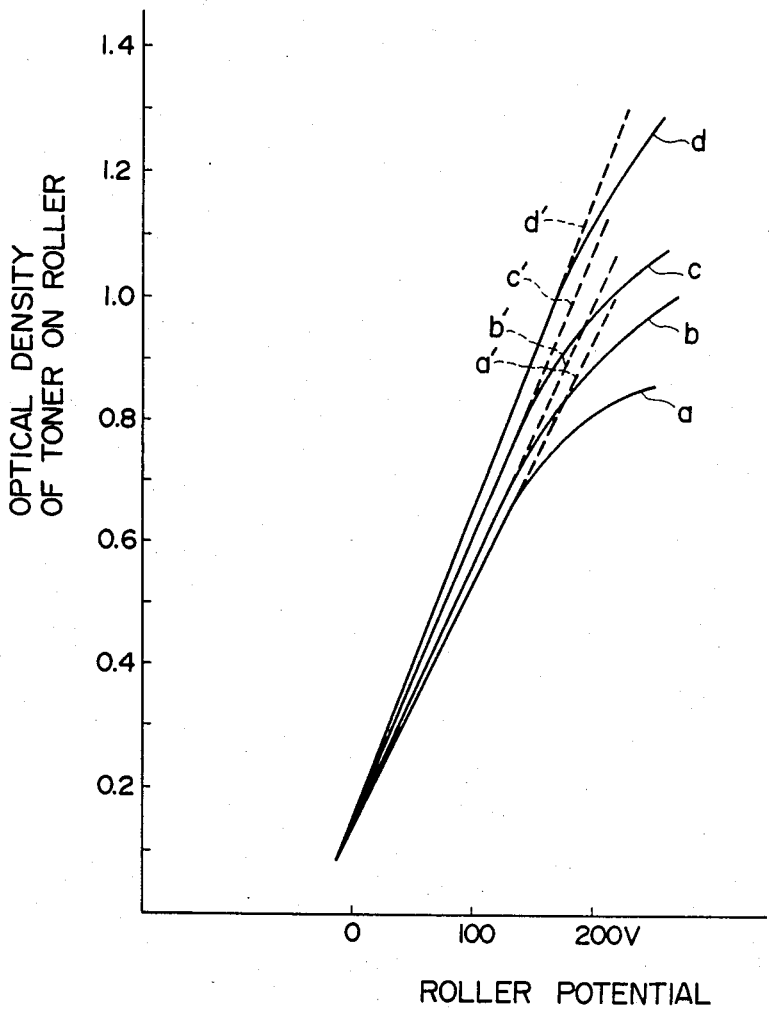
FIGS. 7 and 8 graphically show the optical density of toner on the roller and the potential of the roller as a function of roller potential and a toner mixing ratio, respectively, illustrating the principle of operation of the apparatus shown in FIG. 6.

FIG. 7 graphically shows several characteristic curves obtained by experiments which explain the principle of replenishing a toner from a toner supply roller onto a non-magnetic sleeve according to the invention. Specifically describing the experiments that have been conducted to obtain such results, a carrier comprises an iron powder having a distribution of particle size from 150 to 250 mesh. Several samples of developer a, b, c and d have been prepared by mixing a toner with a carrier in different weight ratios of 6, 7, 8 and 9%. A layer of developer having a thickness of about 3 mm is formed on the non-magnetic sleeve 21, and an aluminium roller, which forms the toner supply roller 22 of the invention, is brought into contact with a tuft of the developer. By applying a voltage in a range from 0 to 250 volts as referenced to the sleeve 21 to the aluminium roller 22, while applying the developer, the toner is caused to be adsorbed by the aluminium roller 22. In FIG. 7, the ordinate represents the optical density of the toner deposited on the aluminium roller while the abscissa represents the potential applied to the aluminium roller as referenced to the sleeve.

The toner attracting electric field which is produced by the bias voltage applied to the aluminium roller is cancelled by the deposition of the charged toner on the aluminium roller. Accordingly, for a low bias voltage, only a small quantity of toner is deposited on the roller. It will be noted in FIG. 7 that the characteristic curves tend to saturate. This is attributable to the fact that the deposition of the toner does not occur until the bias voltage is completely neutralized and that there prevails no proportionality between the toner deposition and the optical density. Dotted lines a', b', c' and d' indicate straight lines which would prevail if the optical density of toner deposited is proportional to the voltage applied.

Figure 8:
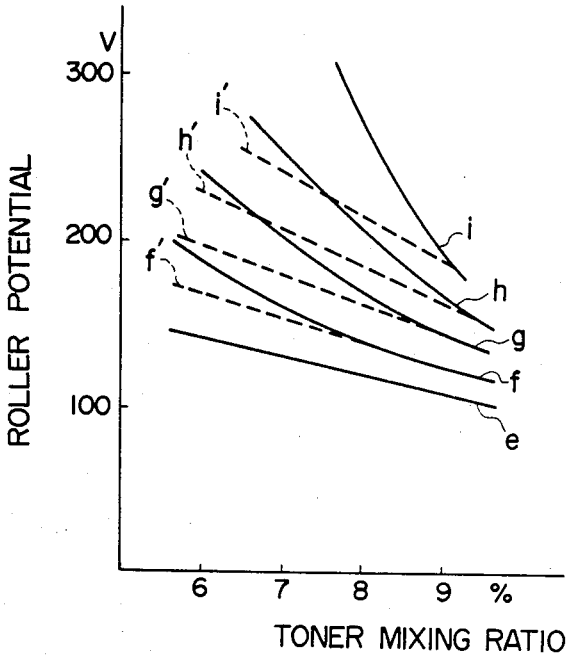

The data illustrated in FIG. 7 can be converted to yield the toner concentration (mixing ratio), shown on the abscissa, as a function of the potential applied to the aluminium roller which is shown on the ordinate, as graphically indicated in FIG. 8. Solid line curves e, f, g, h and i correspond to the optical densities of the toner on the aluminium roller which are equal to 0.7, 0.8, 0.9, 1.0 and 1.1, and dotted line curves f', g', h' and i' correspond to the imaginary dotted lines a', b', c' and d', respectively, shown in FIG. 7. When the voltage applied to the aluminium roller, the thickness of a toner layer on the aluminium roller and the toner mixing ratio of the developer are known, these characteristic curves can be utilized to determine if the toner on the aluminium roller migrates into the developer or the toner in the developer migrates onto the aluminium roller.

As mentioned previously, the aluminium roller functions as the toner supply roller of the invention. To give an example, it may be assumed that a bias voltage of +130 volts is applied to the aluminium roller and an amount of toner corresponding to the optical density of 0.7 is deposited thereon. When it is brought into contact with a developer having a toner mixing ratio of 7%, it can be determined from FIG. 8 that a migration of the toner from the roller into the developer does not occur. However, as the toner in the developer is increasingly consumed to result in a toner mixing ratio which is less than 7%, a migration of the toner occurs from the roller into the developer. Similarly, when a bias voltage of 140 volts is used and the amount of toner on the toner supply roller is chosen to provide a thickness which corresponds to the optical density of 0.8, it will be seen that the replenishment of the toner into the developer occurs when the toner mixing ratio of the developer decreases below 8%.

Figure 9A:
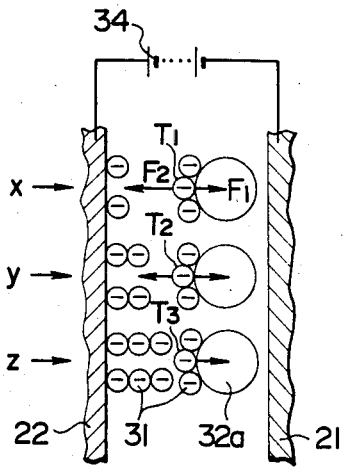
FIGS. 9A and 9B are diagrammatic illustrations of the principle of supplying toner effected in the apparatus of FIG. 6.

The mechanism by which the toner is supplied from the toner supply roller 22 into the developer 32 on the sleeve 21 will be more specifically considered with reference to FIG. 9. FIG. 9A illustrates a change which would occur in the supply of toner when the thickness of a toner layer on the toner supply roller 22 is varied. As shown, the toner 31 on the roller 22 is previously charged to the negative polarity, and the thickness of the toner layer has three different values. The source of bias voltage 34 is connected across the roller 22 and the sleeve 21 so that the roller 22 assumes a potential of the opposite polarity from that of the charge of the toner 31. A magnetic carrier is shown at 32*a*, and toner is mixed with the magnetic carrier 32*a* by adsorption by the latter at a given ratio, as indicated at $T_1$, $T_2$ and $T_3$. In a region x where the toner layer on the roller 22 is thinnest, the bias voltage applied to the roller 22 is slightly cancelled by the charge of the toner since the amount of toner deposited on the roller 22 is at its minimum. Accordingly, an electric field is applied to the toner $T_1$ deposited on the carrier, tending to cause the toner to migrate from the sleeve 21 toward the roller 22. This force $F_2$ which acts in this manner overcomes the force of attraction $F_1$ of the carrier, whereby the toner in the developer migrates onto the roller 22. For a region y where the toner layer on the roller 22 has an increased thickness, the electric field produced by the voltage applied from the source 34 is cancelled by the charge of the toner deposited on the roller 22 to a greater degree than shown for the region x. Force $F_1$ causes the toner $T_2$ to be attracted toward the carrier while the force $F_2$, produced by the electric field established between the surface of the toner layer on the roller 22 and the sleeve 21, tends to move the toner toward the roller. Because the magnitude of these forces are substantially equal to each other, there occurs no migration of the toner in either direction. For a region z where the toner layer on the roller 22 has a further increased thickness, the electric field established by the bias voltage is completely cancelled in the topmost tier on the roller 22, and changes into an electric field acting in the opposite direction which causes the toner on the roller 22 to migrate toward the sleeve 21. Accordingly, when the carrier 32*a* approaches such region, a charge of the opposite polarity which is induced in the carrier produces the force $F_1$ which attracts the toner toward the carrier. In this manner, in addition to the toner $T_3$ which has been held attracted, a peripheral toner is also adsorbed by the carrier, resulting in a migration of the toner into the developer from the toner supply roller 22.

Figure 9B:
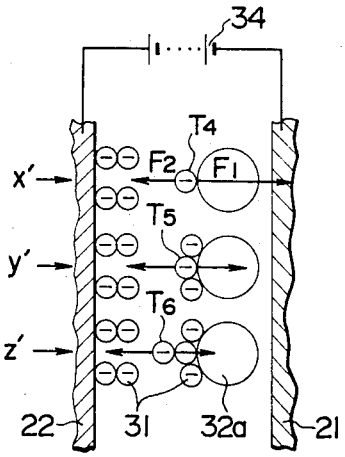

FIG. 9B illustrates a phenomenon which occurs when the toner mixing ratio in the developer is changed while maintaining the thickness of the toner layer on the roller 22 constant. The source 34 is connected in the same manner as shown in FIG. 9A. In a region x', the toner mixing ratio in the developer is less than a given level. The bias voltage applied from the source 34 is substantially cancelled by the toner on the roller 22, but there still remains an electric field established between the topmost toner tier and the sleeve 21 which tends to cause the toner to be attracted toward the roller 22. The resulting force acting on the toner is indicated by $F_2$. A force of attraction $F_1$ acting between the carrier 32*a* and a toner $T_4$ adsorbed thereby has an increased value inasmuch as the toner mixing ratio is low. Under this condition, when the carrier 32*a* and the toner in the topmost tier on the roller 22 move into contact with each other, the force of attraction $F_1$ exerted by the carrier 32*a* overcomes the force $F_2$ developed by the electric field established between the sleeve 21 and the roller 22, whereby the toner is adsorbed by the carrier 32*a*. This phenomenon signifies that as the toner in the developer 32 is consumed and the toner mixing ratio decreases, the toner on the roller 22 automatically replenishes into the developer 32 or sleeve 21.

A region y' indicates that the toner mixing ratio in the developer is at a given level. The force $F_2$ acting upon a toner $T_5$ adsorbed by the carrier 32*a* under the influence of the space field remains the same as the force acting upon the toner $T_4$ mentioned above. The force of attraction $F_1$ exerted by the carrier 32*a* upon the toner diminishes by an amount corresponding to an increase in the toner mixing ratio, whereby both forces $F_1$ and $F_2$ have an equal magnitude, resulting in no migration of the toner $T_5$ in either direction. Thus no replenishment of toner occurs from the roller 22 into the developer 32.

A further region z' indicates that the toner concentration in the developer has increased beyond the given level. As the toner mixing ratio in the developer 32 increases, there is some toner $T_6$ which is attracted to the carrier 32*a* with a reduced force. The force $F_2$ acting upon the toner $T_6$ under the influence of the space field exceeds the force $F_1$ exerted by the carrier 32*a* upon the toner $T_6$, so that an excessive amount of toner in the developer is transferred onto the roller 22, thus decreasing the concentration of the developer.

It will be readily apparent from the above description made with reference to FIGS. 9A and 9B concerning the principle of toner migration that the toner mixing ratio in the developer can be maintained at a given level by initially providing a developer having a given toner mixing ratio, maintaining a constant thickness of toner layer on the toner supply roller 22 with a toner previously charged, and establishing across the sleeve 21 and the roller 22 a potential difference of a marginal level which does not cause any migration of toner between the roller and the developer under the described conditions. More specifically, if the toner mixing ratio decreases as a result of the consumption of toner in the developer, the toner is replenished from the roller 22 into the developer until the given level is recovered, whereupon a further replenishment of toner is interrupted. On the contrary, if the toner mixing ratio in the developer increases temporarily as when cleaning the developing apparatus or if an increased toner mixing ratio occurs locally within the developer, the toner in the developer migrates onto the roller 22 so as to correct the mixing ratio to the given level.

In the embodiment shown in FIG. 6, the source of bias voltage 34 is connected between the non-magnetic sleeve 21 and the toner supply roller 22 to establish a necessary potential difference therebetween. This potential difference is chosen in a manner such that the replenishment of toner from the roller 22 into the developer 32 is interrupted when the toner mixing ratio in the developer 32 has reached a given level, for example, a toner mixing ratio which might prevail in an unused developer. However, the value of the potential difference varies with various factors of the developing apparatus, and hence must be determined by experiments.

While the source of bias voltage 34 is directly connected between the non-magnetic sleeve 21 and the toner supply roller 22 to establish a potential difference therebetween in this embodiment, it should be obvious that an electrically equivalent result can be achieved by connecting a source of bias voltage between the roller 22 and the ground to establish a necessary potential difference.

Figure 10:
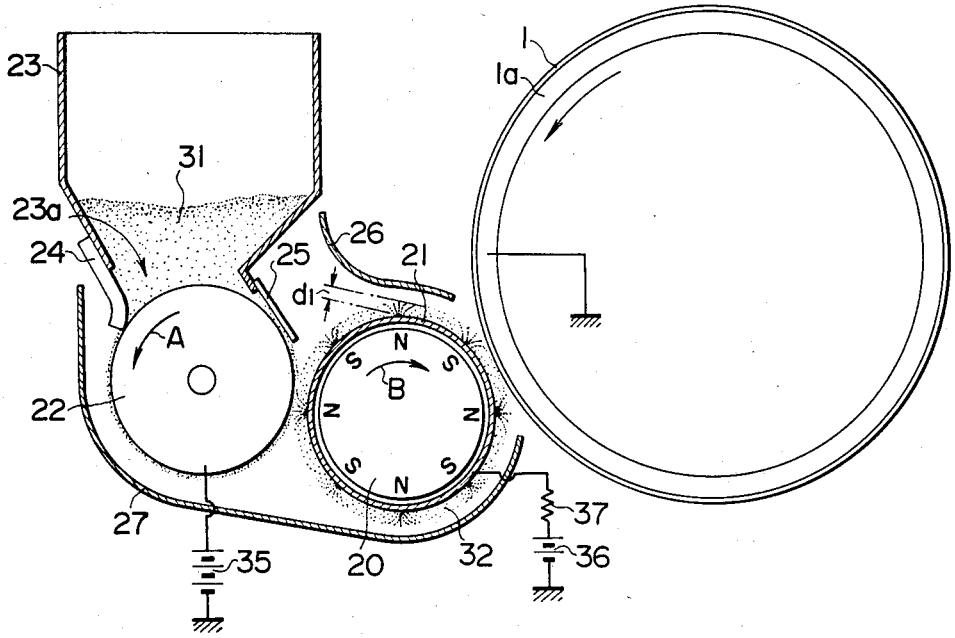
FIGS. 10 and 11 are schematic views of apparatus for developing an electrostatic latent image according to other embodiments of the invention.

FIG. 10 shows a further embodiment which achieves the replenishment of toner in a more effective manner, based on the mechanism mentioned above. In this embodiment, separate sources of bias voltages 35, 36 are connected between the toner supply roller 22 and the ground and between the non-magnetic sleeve 21 and the ground, respectively. In addition, a resistor 37 of a high resistance is connected in series with the source 36 which is connected to the non-magnetic sleeve. In this arrangement, a current which flows from the sleeve 21 to the ground depends on the consumption of toner during the developing process and the replenishment of toner from the roller 22. Accordingly, when the consumption of toner increases, the resulting current develops a voltage drop across the resistor 37, which promotes the replenishment of toner from the roller 22 into the developer 32.

During the developing process, when the toner is deposited on the surface on which a latent image is formed, the charge which the carrier carries in correspondence to the charge of the toner will be surplus, and such charge flows from the sleeve 21 through the resistor 37 and the source 36 to the ground. When the toner is charged to the negative polarity, the charge of the carrier is of positive polarity, and hence the voltage drop developed across the resistor 37 by the resulting current flow during the developing process raises the potential of the sleeve 21 to a higher value. Consequently, the replenishment of the toner from the roller 22 into the developer is enhanced. However, part of the developing current is used to maintain the positive charge on the carrier which is required to effect the replenishment of the toner into the developer. A significant change in the potential of the sleeve will occur during the developing process when developing a zone of an image having an increased black area, and it is found by experiments that this will occur when the resistor 37 has a resistance greater than 10 MΩ. When the resistance becomes equal to or exceeds 1,000 MΩ, the sleeve potential or a developing bias voltage will be excessively high in an image zone having an increased black area, disadvantageously causing a substantial reduction in the optical density of the image. Conversely, if the resistance is too low, there will be no substantial change in the sleeve potential, which prevents the intended effect of the present embodiment from occurring. Accordingly, it is generally most effective and immune from drawbacks that a resistance in a range from 20 to 500 MΩ be chosen even though the exact value depends on a particular developing apparatus.

Figure 11:
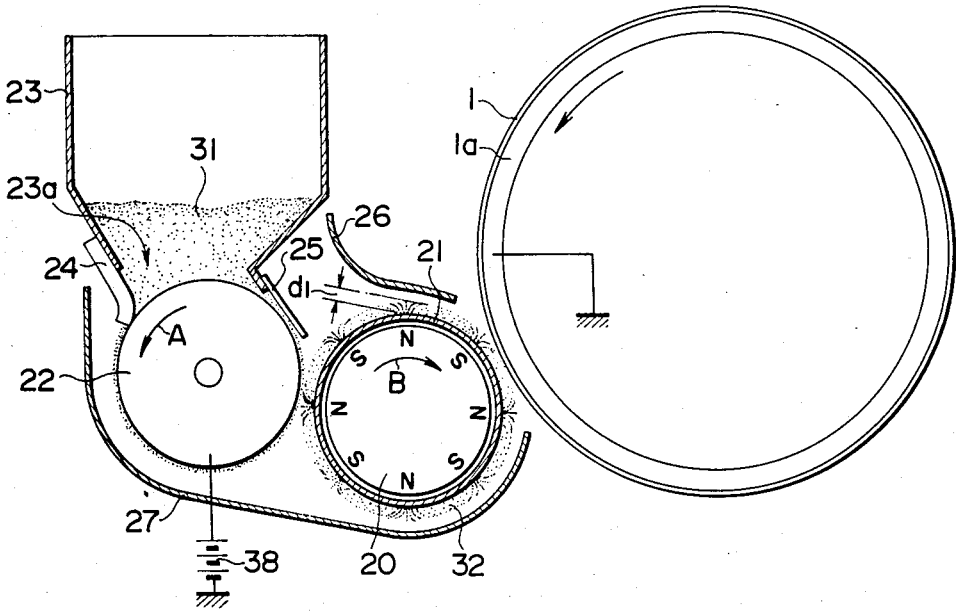

FIG. 11 shows another embodiment which is substantially equal to and provides the same effect as the embodiment shown in FIG. 10, but in which the provision for a source of bias voltage is simplified. In this embodiment, a source of bias voltage 38 is connected to only the toner supply roller 22 while the non-magnetic sleeve 21 is maintained as insulated. Accordingly, a developing bias is applied to the non-magnetic sleeve 21 and the region to be developed through the roller 22 and the developer. A surplus charge on the carrier which is developed during the developing process flows through the developer and the roller 22 to the source 38. It is to be noted, however, that the embodiment shown in FIG. 11 is inapplicable to an arrangement which utilizes a developer which exhibits an extremely low or high resistance. Nevertheless, a tuft on the sleeve which is disposed in contact with the toner supply roller 22 corresponds to the resistor 37 in the embodiment of FIG. 10, and hence a degree of adjustment can be made depending on the resistance of the developer, by adjusting the spacing between the roller 22 and the sleeve 21 or by adjusting the thickness of a developer layer on the sleeve 21. It is readily possible to find a magnetic two-component developer which is commonly used and which exhibits the order of resistance (20 to 500 MΩ) contemplated herein during use, and hence it is concluded that this embodiment is also applicable with common developers.

Figure 12:
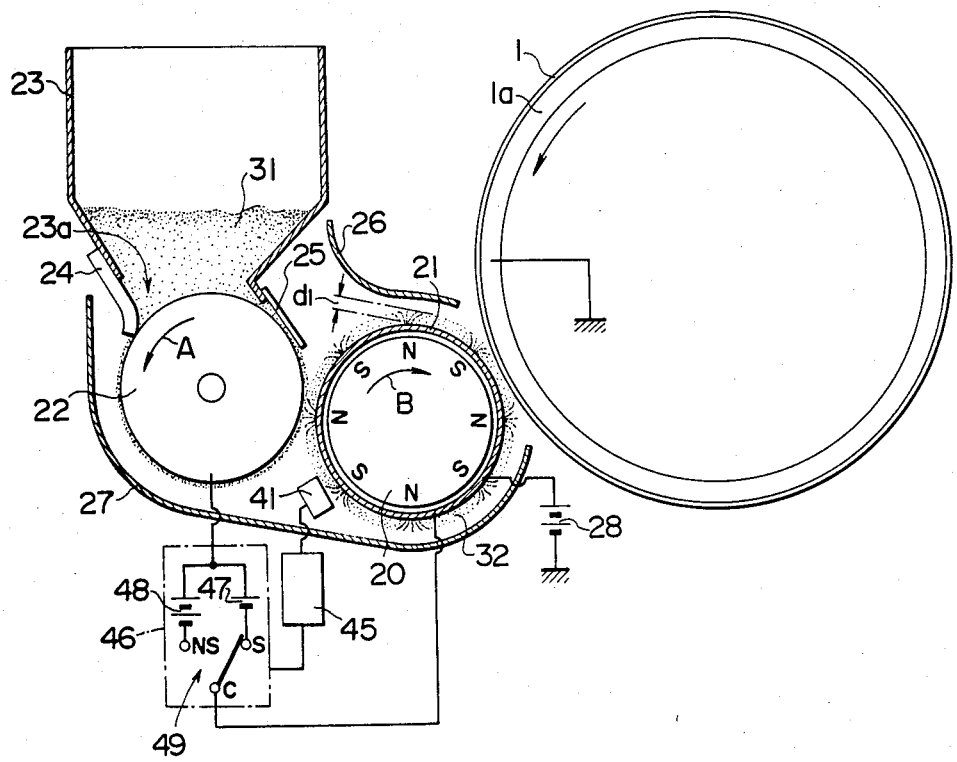
FIG. 12 is a schematic view of an apparatus for developing an electrostatic latent image according to a further embodiment of the invention.

FIG. 12 shows a further embodiment of the invention in which the developing apparatus includes means for detecting a toner mixing ratio in the developer 32. An output from the detecting means is used to change a bias voltage applied between the non-magnetic sleeve 21 and the toner supply roller 22.

Figure 13:
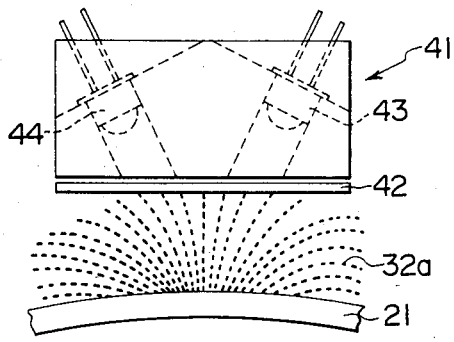
FIG. 13.is a schematic illustration of one form of detector used in the apparatus of FIG. 12.

One of measures which indicate the developing capability of a developer is the toner mixing ratio in the developer. In the present embodiment, an optical detector 41 as shown in FIG. 13 is used in the developing apparatus for purpose of detecting the toner mixing ratio. The detector 41 has previously been proposed by the inventor of the present application (see Japanese Patent Application No. 57,633/1981), and comprises a light source and a light receiver 43, 44 covered by a light transmitting seal plate 42 adjacent to a tuft 32*a* of the developer 32 formed on a non-magnetic sleeve 21 for detecting a change in the optical reflectivity which results from a change in the toner mixing ratio of the developer 32.

A signal from the detector 41 is fed to a control circuit 45, an output signal of which is used to control a variable bias unit 46 which applies a bias voltage between the non-magnetic sleeve 21 and the toner supply roller 22. The unit 46 includes a source 47 which supplies a less positive (or a negative) potential to the roller 22 in reference to the sleeve 21, and also includes another source 48 which supplies a high positive potential. The unit 46 includes a changeover switch 49 which selectively connects one of the sources 47, 48 to the sleeve 21. The switch 49 has a common terminal C connected to the sleeve 21, and also includes transfer terminals S, NS which are connected to the sources 47, 48, respectively. It will be appreciated that the switch 49 is controlled by a control signal from the control circuit 45. When the detector 41 detects that the toner mixing ratio of the developer is higher than a given level, the switch 49 is thrown to provide a connection between the terminals C and NS. Consequently, the roller 22 is biased to a higher positive potential than the sleeve 21, whereby toner cannot be removed from the roller 22 and hence cannot be replenished. By contrast, when the detector detects that the toner mixing ratio is lower than the given level, the switch 49 is thrown to the terminal S, whereupon the roller 22 is biased to a less positive potential with respect to the sleeve 21, allowing the toner to be replenished into the developer from the roller 22.

Figure 14:
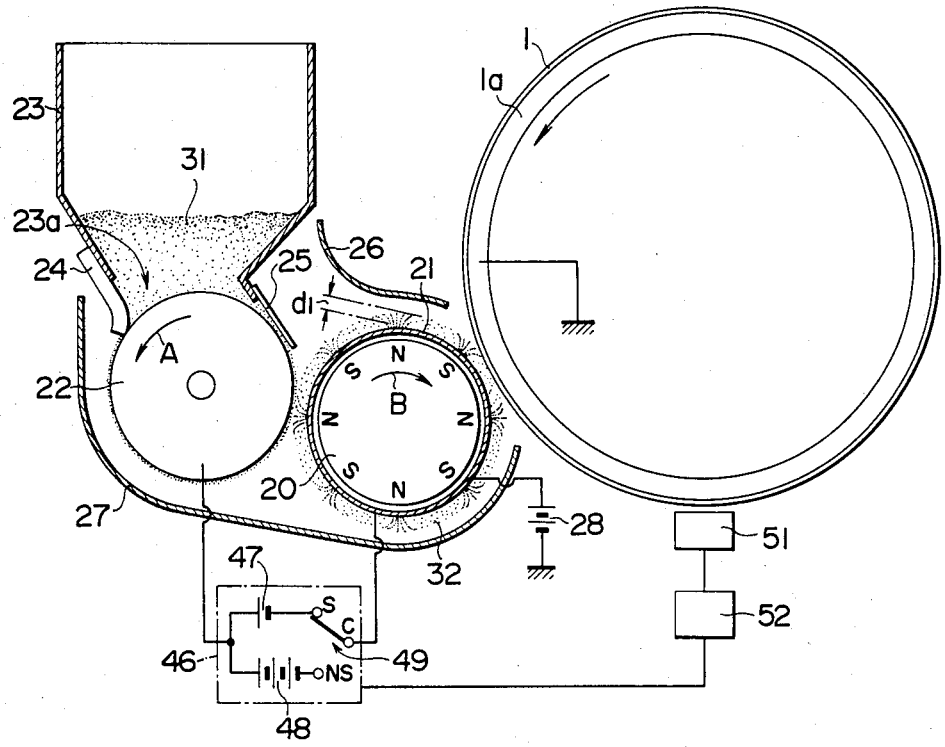
FIG. 14 is a schematic view of an apparatus for developing an electrostatic latent image according to still another embodiment of the invention.

In the embodiment shown in FIG. 12, a detector has been provided for detecting the toner mixing ratio in the magnetic two-component developer. The signal from the detector has been used to control the variable bias unit, thereby controlling the replenishment of the toner from the toner supply roller into the developer. However, the replenishment of toner can also be controlled by determining the developing performance of the developer on the basis of a different principle. By way of example, FIG. 14 shows an embodiment in which a pattern of electrostatic charge having a particular potential is established on a charge retaining member 1 in order to allow the determination of the performance of a developer. When the pattern is developed with the developing apparatus, the optical density of a resulting toner image of the pattern is determined by means of a photoelectric sensing element 51, a signal from which is fed to a control circuit 52. An output signal from the control circuit 52 is used to control a variable bias unit 46. If the optical density of the developed toner image corresponding to the pattern is high, a bias voltage applied to the toner supply roller 22 is increased, thus ceasing the replenishment of the toner from the roller 22 into the developer. When the optical density is low, the bias voltage is lowered to allow the replenishment of toner into the developer.

In the embodiments shown in FIGS. 12 and 14, the developer moves around the sleeve in a circulating manner without being removed from the non-magnetic sleeve. However, the developer may be once removed from the sleeve and then caused to be attracted onto the sleeve, as effected in a conventional developing unit, in order to increase the amount of developer which can be contained within the developing apparatus. It is also possible to use a magnetic toner containing a magnetic powder in order to form a developer. This effectively prevents the occurrence of fogging over a background area or a scattering of toner. In the embodiments shown in FIGS. 12 and 14, the variable bias unit has been shown in order to illustrate the principle, but it should be understood that a variety of arrangements may be used to this end.

Figure 15:
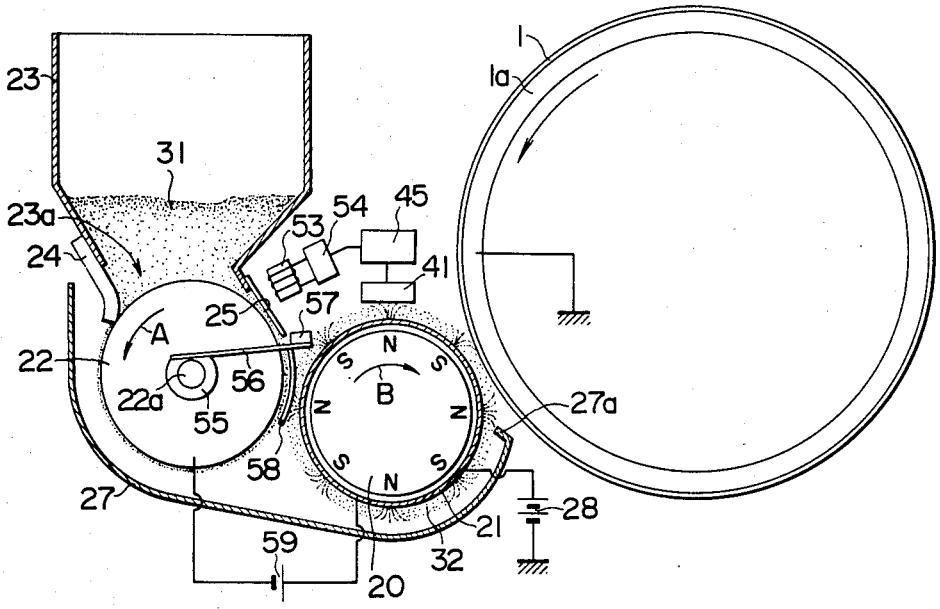
FIG. 15 is a schematic view of an apparatus for developing an electrostatic latent image according to a still further embodiment of the invention.

FIG. 15 shows a still further embodiment of the invention. In this embodiment, an apparatus for developing an electrostatic latent image includes means producing a signal indicative of the developing capability of a developer so that control means which controls a mechanical contact between a toner and a developer may be controlled in accordance with such signal, thereby maintaining the developing capability of the developer at a given level.

Specifically, it will be noted that the developing apparatus of this embodiment is not provided with the upper dust cover 26 which has been provided in other embodiments. Instead, a detector 41 is disposed above a non-magnetic sleeve 21 for detecting the toner mixing ratio of a developer 32 that is carried by the non-magnetic sleeve 21. The detector 41 may comprise an optical detector as illustrated in FIG. 13, for example, and is connected through a control circuit 45 to a drive circuit 54 associated with an electromagnet 53. A toner supply roller 22 is mounted on a shaft 22*a*, on which a flange member 55 is rotatably mounted, the flange member 55 carrying an arm 56. An armature 57 is fixedly mounted on the free end of the arm 56 so as to be attracted by the electromagnet 53. A shield plate 58 is disposed so as to be moved into the space between the toner supply roller 22 and the non-magnetic sleeve 21. A source of bias voltage 59 is connected between the roller 22 and the sleeve 21, with the positive terminal of the source being connected to the sleeve. A doctor blade 27*a* is mounted on one end of the lower dust cover 27 so as to be located opposite to the sleeve 21.

It will be understood that the volume of a magnetic two-component developer varies with a change in the toner mixing ratio and the agitating effect. Consequently, a tuft of developer may have a varying height, and where the developing capability, the toner mixing ratio or the replenishment of toner is not stabilized, the height of the tuft may be maintained constant by the action of the doctor blade 27*a* disposed in a path along which the developer is conveyed. Where the doctor blade 27*a* is provided, a degree of standing toner may form adjacent to the blade and the developer 32 may become removed from the sleeve 21 if such mass grows excessively. However, the removed developer may be received by the dust cover 27 so as to remain within the magnetic influence of a magnet roller 20, thus allowing it to be circulated again and preventing a wasteful stagnation or leakage of developer, even though it may be desirable to choose an amount of developer that is loaded so as to prevent such removal. If the amount of developer loaded is increased to achieve an increased period for changing the developer, there will be an increased amount of toner removed from the sleeve which is situated beyond the magnetic influence of the magnet roller. In such instance, mechanical developer conveying means, for example, agitating blade means as used in a conventional developing unit, may be provided to assure uniform circulation of the developer. However, such conveying means may be simplified in construction since it does not function to mix and agitate the developer with the toner.

The toner present on the roller 22 is previously charged, and is transferred into the developer 32 by the electrostatic attraction mechanism mentioned above. The source 59 connected between the roller 22 and the sleeve 21 provides a bias voltage which establishes a potential difference for transferring the toner between the roller 22 and the developer 32.

Where a magnetic toner is used, the toner can be transferred into the developer from the roller 22 under the action of magnetic attraction, thus allowing the source of bias voltage 59 to be dispensed with. Alternatively, where a magnetic toner is used, both the magnetic and the electrostatic attraction may be used in combination for transferring the toner from the roller into the developer. This is particularly effective for a magnetic toner having magnetic powder content equal to or less than 30% by weight.

It is to be noted that in the embodiment shown in FIG. 15, if the roller 22 is left in contact with the developer 32 while energizing the source 59 or applying the magnetic force in connection with the magnetic toner, the continued rotation of the roller 22 will cause an excessive amount of toner to be transferred into the developer 32. Accordingly, additional means must be provided to maintain the toner mixing ratio of the developer 32 at a given value.

To this end, the shield plate 58 is disposed in the present embodiment and is movable into and out of the space between the roller 22 and the sleeve 21 for controlling the contact between the toner and the tuft of the developer. Specifically, the shield plate 58 and the arm 56 which fixedly carries the armature 57 tend to rotate clockwise about the shaft 22*a* under the influence of the gravity, and arc positioned by a stop, not shown, such that the shield plate 58 is located in a region where the roller 22 and the sleeve 21 are closest to each other. Under this condition, a contact between the roller 22 and the tuft of the developer 32 is intercepted by the shield plate 58, and hence the toner on the roller 22 cannot be transferred into the developer 32.

When the transfer of the toner into the developer is interrupted, the toner mixing ratio of the developer gradually decreases. Such decrease is detected by the detector 41 which produces a signal which is in turn fed through the control circuit 45 and the drive circuit 54 to energize the electromagnet 53, whereupon the armature 57 is attracted by the electromagnet 53 to move the arm 56 as well as the shield plate 58 upwardly.

The upward movement of the shield plate 58 allows contact to occur between the toner on the roller 22 and the developer 32, thus transferring the toner into the developer. Such transfer is continued until the toner mixing ratio of the developer recovers to the given value, whereupon the detector 41 deenergizes the electromagnet 53, causing the shield plate 58 to be returned to the position shown, thus terminating the replenishment of the toner.

Alternative arrangements are contemplated for disposing a shield plate so as to be movable into or out of the space between the toner supply roller and the non-magnetic sleeve. For example, the flange member 55 carrying the arm 56 may be mounted on a shaft associated with the magnet roller to produce a similar operation as illustrated in FIG. 15. Other arrangements are also possible for causing an up-and-down motion of a shield plate in the form of a plate or sheet.

Figure 16:
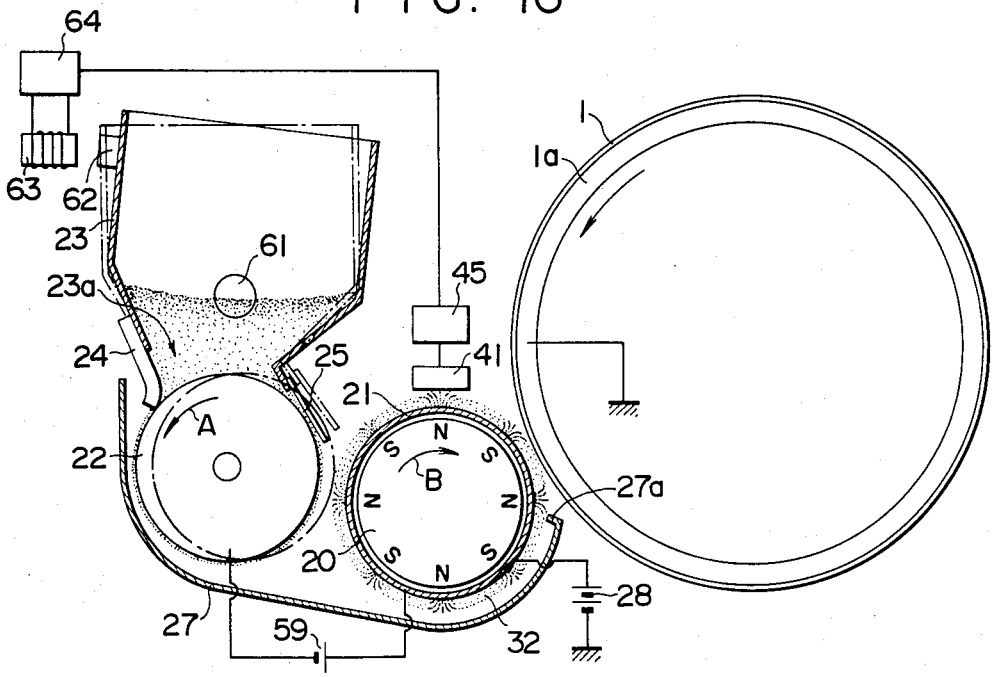
FIGS. 16 and 17 are schematic views of apparatus for developing an electrostatic latent image according to still other embodiments of the invention.

FIG. 16 shows an additional embodiment of the invention in which the spacing between a toner supply roller and a non-magnetic sleeve is changed to control contact between a toner on the roller and a developer. In this embodiment, a toner supply roller 22 and a toner hopper 23 are integrally constructed into an assembly which is rockably mounted on a support shaft 61. An armature 62 is attached to the outer wall of the hopper 23 adjacent to its top end, and an electromagnet 63 is disposed so as to be opposite to the electromagnet 63. The armature 62 is connected to a drive circuit 64 which is operated in response to an output from a detector 41 which is fed through a control circuit 45. The location of the support shaft 61 is chosen to be above the center of gravity of the assembly comprising the roller 22 and the hopper 23, and the assembly is positioned so that there occurs no contact between the roller 22 and a tuft of the developer when the assembly assumes its rest position achieved by the gravity or a spring, not shown.

When a reduction in the toner mixing ratio of the developer 32 is detected by the detector 41, the electromagnet 63 is energized to attract the armature 62, whereupon the assembly rotates counter-clockwise about the shaft 61, causing the roller 22 to assume its phantom line position where it is disposed in contact with the tuft of developer formed on the sleeve 21. The replenishment of toner is effected under this condition until the toner mixing ratio recovers to a given level, whereupon the electromagnet 63 is deenergized, allowing the assembly to return to its original position and terminating the act of replenishment of the toner.

Since the assembly of the hopper 23 and the roller are rockable about the shaft 61 in this embodiment, an additional advantage is gained that the occurrence of a toner blocking within the hopper is prevented. Since the toner hopper, the toner supply roller, the blade and the shield plate move while they are integrally assembled, the relative position therebetween can be exactly maintained, preventing any toner leakage despite a movement of the roller. It is to be noted that a mechanism shown in FIG. 16 for moving the toner supply roller may be modified in any desired manner.

Figure 17:
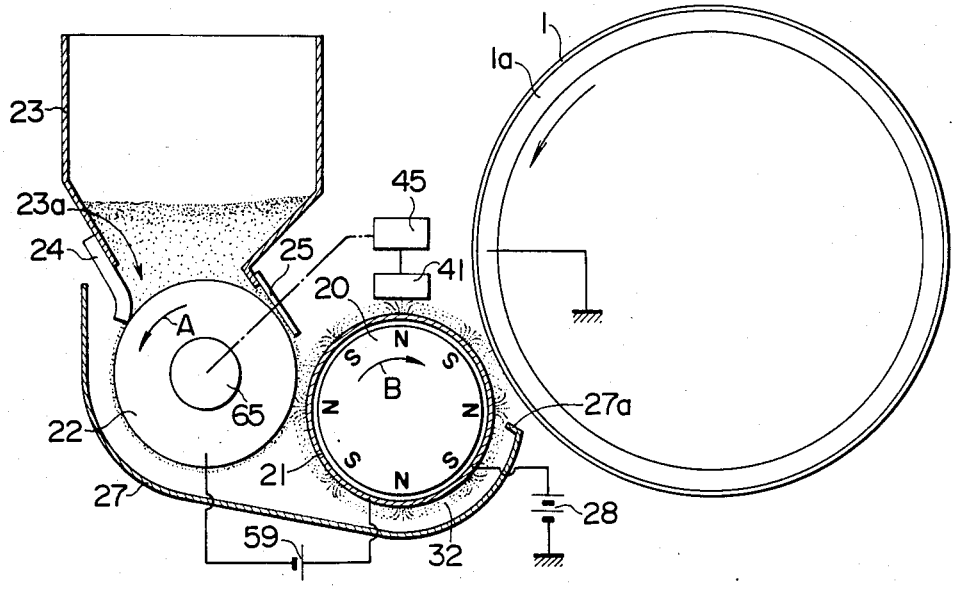

FIG. 17 shows still another embodiment in which a contact between the toner on the toner supply roller and the developer is controlled by controlling the rotation of the toner supply roller. In this embodiment, a contact between the toner and the developer is controlled by turning the rotation of a toner supply roller 22 on and off in response to a signal indicative of the toner mixing ratio in the developer. Specifically, there is shown a motor 65 including a reduction gear head for driving the rotary shaft of the toner supply roller 22. When a developer 32 exhibits a given toner mixing ratio, the motor 65 is deenergized, and hence the roller 22 does not rotate, preventing the replenishment of fresh toner. While the roller 22 is in contact with a tuft of the developer 32, the tuft does not contact the toner. However, as the toner within the developer is consumed to reduce the mixing ratio, the detector 41 detects this by providing a signal which is fed through a control circuit 45 to energize the motor 65. As the motor 65 rotates, the toner supply roller 22 carrying a charged toner on its surface rotates in a direction indicated by arrow A, whereby the toner thereon is brought into contact with the tuft of the developer, thus transferring the toner into the developer. When the toner mixing ratio of the developer recovers to a given level as a result of the replenishment of toner, such condition is again detected by the detector 41 to deenergize the motor 65. Subsequently, contact between the toner on the roller 22 and the developer is again interrupted.

In the embodiment shown in FIG. 17, the toner supply roller has been directly driven by a devoted motor. However, alternatively, the rotation of the magnet roller 20 or the non-magnetic sleeve 21 may be transmitted to the toner supply roller through a gear or belt while controlling the rotation of the roller by means of an electromagnetic clutch or a spring clutch.

In the embodiments shown in FIGS. 15, 16 and 17, the developing capability of the developer has been determined by a detector which determines the toner mixing ratio of the developer. However, other means may be used which detects the developing performance of the developer. By way of example, a latent image having a particular potential may be formed on the charge retaining member in a region outside an image field so that when the latent image is developed, the optical density of the resulting toner image is detected by photoelectric sensing means to control a contact between the toner on the roller and the developer in order to control the replenishment of toner into the developer.

What is claimed is:

1. An apparatus for developing an electrostatic latent image formed on a charge retaining member and including magnetic conveying means having a magnet roller and a non-magnetic sleeve, the magnetic conveying means applying a magnetic two-component developer including a toner and a magnetic carrier to the latent image to form a toner image by conveying the developer to the latent image;

characterized in that developer is adapted to be retained on the non-magnetic sleeve against removal under a magnetic influence of the magnet roller and is conveyed by a rotation of either the magnet roller or the non-magnetic sleeve or both while maintaining a turt thereof;

further comprising a toner hopper for containing the toner and having a bottom opening;

a toner supply roller rotatably disposed and located opposite to the bottom opening of the hopper and the non-magnetic sleeve;

means for creating an electrical field between said supply roller and said sleeve; and means for forming a thin uniform layer of toner on the surface of the toner supply roller while electrically charging the toner, the tuft of the conveyed developer being brought into contact with the thin uniform toner layer on the toner supply roller to transfer only the electrically charged toner into the developer, whereupon the developer and the toner are mixed and agitated together on the non-magnetic sleeve.

2. An apparatus according to claim 1 in which the toner comprises a magnetic toner including magnetic powder and is transferred into the developer on the non-magnetic sleeve from the toner supply roller under a magnetic influence.

3. An apparatus according to claim 1 in which the means for providing an electrical field comprises means for providing a bias voltage between the toner supply roller and the non-magnetic sleeve, the charged toner being transferred into the developer on the non-magnetic sleeve from the toner supply roller under the action of an electrostatic attraction.

4. An apparatus according to claim 1 in which the hopper has a blade attached to one of sidewalls thereof adjacent to the bottom opening and a seal plate attached to the other sidewall adjacent to the bottom opening, the blade acting as means to form a thin uniform toner layer, both the blade and the seal plate being disposed adjacent to the toner supply roller to seal a clearance between the bottom opening of the toner hopper and the toner supply roller.

5. An apparatus for developing an electrostatic latent image formed on a charge retaining member and including magnetic conveying means having a magnet roller and a non-magnetic sleeve, the magnetic conveying means applying a magnetic two-component developer comprising a toner and a magnetic carrier to the latent image while conveying the developer, thereby forming a toner image; comprising a rotatable toner supply roller disposed in spaced relationship with the magnetic sleeve for contact with a tuft of developer formed on the non-magnetic sleeve to supply a toner thereto;

means for forming a thin uniform layer of toner on the surface of the toner supply roller while charging the toner; and means for establishing a potential difference between the non-magnetic sleeve and the toner supply roller, the potential being at a level which ceases supply of the toner from the toner supply roller into the developer whenever a toner mixing ratio of the developer reaches a given value, whereby only the charged toner is transfered into the developer through a tuft thereof from the toner supply roller as the toner is consumed during a developing process, thus maintaining the toner mixing ratio of the developer at a given level.

6. An apparatus according to claim 5 in which said means for establishing a potential difference comprises a source of bias voltage connected between the non-magnetic sleeve and the toner supply roller.

7. An apparatus according to claim 5 in which said means for establishing a potential difference comprises a first source of a bias voltage connected between the toner supply roller and the ground and a second source of bias voltage connected between the non-magnetic sleeve and the ground in series with a resistor having a high resistance.

8. An apparatus according to claim 5 in which said means for establishing a potential difference comprises a source of bias voltage connected to the toner supply roller while said non-magnetic sleeve is supported in an insulated manner.

9. An apparatus for developing an electrostatic latent image formed on a charge retaining member and including magnetic conveying means having a magnet roller and a non-magnetic sleeve, the magnetic conveying means applying a magnetic two-component developer comprising a toner and a magnetic carrier to the latent image while it conveys the developer, thereby forming a toner image; comprising a toner supply roller rotatably disposed for contact with a tuft of the developer formed on the non-magnetic sleeve to supply a toner thereto;

means for forming a thin uniform layer of toner on the surface of the toner supply roller while charging the toner;

means for detecting a developing performance of the developer; and a variable bias source for establishing a potential difference between the toner supply roller and the non-magnetic sleeve and controlled in response to a signal from the detecting means, said signal controlling the replenishment of the charged toner into the developer by controlling the variable bias source.

10. An apparatus according to claim 1 in which the control means comprises a shield plate movable into and out of a space between the toner supply roller and the non-magnetic sleeve.

11. An apparatus according to claim 1 in which the control means comprises means for moving the toner supply roller in a direction to change the separation between the toner supply roller and the non-magnetic sleeve.

12. An apparatus for developing an electrostatis latent image formed on a charge retaining member and including magnetic conveying means having a magnet roller and a non-magnetic sleeve, the magnetic conveying means applying a magnetic two-component developer comprising a toner and a magnetic carrier to the latent image while it conveys the developer, thus forming a toner image; comprising a toner supply roller rotatably disposed for contact with a tuft of developer formed on the non-magnetic sleeve to supply a toner thereto;

a toner hopper having a bottom opening in which the toner supply roller is disposed;

means for delivering a thin layer of charged toner from said hopper to said toner supply roller;

said delivering means including a blade attached to one of sidewalls of the toner hopper adjacent to the bottom opening thereof and defining means to form a thin uniform layer of toner on said toner supply roller; and a seal plate of a resilient material attached to the other sidewall of the toner hopper adjacent to the bottom opening;

both the blade and the seal plate being disposed adjacent to the toner supply roller to seal a clearance between the bottom opening of the toner hopper and the toner supply roller; and an electrical field being provided between the toner supply roller and the non-magnetic sleeve to control the transfer of charged toner to said non-magnetic sleeve from said toner supply roller.

* * * * *

UNITED STATES PATENT AND TRADEMARK OFFICE

CERTIFICATE OF CORRECTION

PATENT NO. : 4,615,606

DATED : October 7, 1986

INVENTOR(S) : Masaji Nishikawa

It is certified that error appears in the above-identified patent and that said Letters Patent is hereby corrected as shown below:

IN THE SPECIFICATION

Column 16, line 66, before "measures" insert --the--.

IN THE CLAIMS

Column 21, Claim 1, line 31, before "for" insert --of reduced size and complexity--.

line 42, change "and is" to --which exerts said magnetic influence upon the developer throughout the movement of the developer about the non-magnetic sleeve to retain the developer on the sleeve said developer being--.

line 52, before "for" insert --on the roller surface of the toner supply roller and cooperating blade means slidingly engaging the toner supply roller surface--.

UNITED STATES PATENT AND TRADEMARK OFFICE

CERTIFICATE OF CORRECTION

PATENT NO. : 4,615,606

DATED : October 7, 1986

INVENTOR(S) : Masaji Nishikawa

It is certified that error appears in the above-identified patent and that said Letters Patent is hereby corrected as shown below:

line 53, before "while" insert -- as the supply roller surface moves away from the bottom opening,--.

line 55, before "being" insert --formed due to the magnetic attraction of the magnet roller--.

line 56, after "roller", insert --at a first location--.

line 60, change "sleeve." to --sleeve as the developer moves from the first location to a second location where it is conveyed to the latent image, said developer remaining on said non-magnetic sleeve due to said magnetic attraction and the elimination of any scraping means and/or stirring means between the first and second locations.--.

Column 22, Claim 5, line 18, before "applying" insert --providing a magnetic force for retaining developer on said sleeve throughout the developing operation and for--.

before "a" insert --said developer, which is--.

line 19, after "carrier", insert--,--.

UNITED STATES PATENT AND TRADEMARK OFFICE

CERTIFICATE OF CORRECTION

PATENT NO. : 4,615,606

DATED : October 7, 1986

INVENTOR(S) : Masaji Nishikawa

It is certified that error appears in the above-identified patent and that said Letters Patent is hereby corrected as shown below:

line 40, change "level." to --level said developer remaining on said sleeve throughout the developing operation due to said magnetic attraction and due to the elimination of scraping and/or stirring means typically required in conventional apparatus.--.

Column 23, Claim 9, line 6, delete "variable".

line 6, change "for" to --having first and second operating states for respectively--.

line 8, before "in" insert --to either prevent any transfer of toner or to permit transfer of toner--.

line 9, after "a" insert --control--.

line 11, delete "variable".

line 12, change "source." to --source to operate in the second operating state when the detecting means senses the need for replenishment.--

UNITED STATES PATENT AND TRADEMARK OFFICE

CERTIFICATE OF CORRECTION

PATENT NO. : 4, 615,606

DATED : October 7, 1986

INVENTOR(S) : Masaji Nishikawa

It is certified that error appears in the above-identified patent and that said Letters Patent is hereby corrected as shown below:

Column 23, Claim 10, line 13, delete "according to Claim 10 in which the" and insert --for developing an electrostatic latent image formed on a charge retaining member and including magnetic conveying means having a magnet roller and a non-magnetic sleeve, the magnetic conveying means applying a magnetic two-component developer comprising a toner and a magnetic carrier to the latent image while it conveys the developer, thereby forming a toner image; comprising a toner supply roller rotatably disposed for contact with a tuft of developer formed on the non-magnetic sleeve to supply a toner thereto;

means for forming a thin uniform layer of toner on the surface of the toner supply roller while charging the toner;

means for detecting the developing capability of the developer;

control means for controlling contact between the toner on the toner supply roller and the developer on the non-magnetic sleeve and in response to a signal from the detecting means, the transfer of the charged toner being controlled by controlling contact between the toner on the toner supply roller and the developer on the non-magnetic sleeve in response to a signal from the detecting means, thus maintaining the developing capability of the developer at a given level; said--.

UNITED STATES PATENT AND TRADEMARK OFFICE

CERTIFICATE OF CORRECTION

PATENT NO. : 4,615,606

DATED : October 7, I986

INVENTOR(S) : Masaji Nishikawa

It is certified that error appears in the above-identified patent and that said Letters Patent is hereby corrected as shown below:

line 14, change "comprises" to --comprising--.

Column 23, Claim 11, line 17, delete "according to Claim 10 in which the" and insert --for developing an electrostatic latent image formed on a charge retaining member and including magnetic conveying means having a magnetic roller and a non-magnetic sleeve, the magnetic conveying means applying a magnetic two-component developer comprising a toner and a magnetic carrier to the latent image while it conveys the developer, thereby forming a toner image; comprising a toner supply roller rotatably disposed for contact with a tuft of developer formed on the non-magnetic sleeve to supply a toner thereto;

means for forming a thin uniform layer of toner on the surface of the toner supply roller while charging the toner;

means for detecting the developing capability of the developer;

UNITED STATES PATENT AND TRADEMARK OFFICE

CERTIFICATE OF CORRECTION

PATENT NO. : 4,615,606

DATED : October 7, 1986

INVENTOR(S) : Masaji Nishikawa

It is certified that error appears in the above-identified patent and that said Letters Patent is hereby corrected as shown below:

control means for controlling contact between the toner on the toner supply roller and the developer on the non-magnetic sleeve in response to a signal from the detecting means, the transfer of the charged toner being controlled by controlling contact between the toner on the toner supply roller and the developer on the non-magnetic sleeve in response to a signal from the detecting means, thus maintaining the developing capability of the developer at a given level;--.

line 18, before "control" insert --said--.

line 18 change "comprises" to --comprising--.

UNITED STATES PATENT AND TRADEMARK OFFICE

CERTIFICATE OF CORRECTION

PATENT NO. : 4,615,606

DATED : October 7, 1986

INVENTOR(S) : Masaji Nishikawa

It is certified that error appears in the above-identified patent and that said Letters Patent is hereby corrected as shown below:

line 22, Claim 12, change "electrostatis" to --electrostatic--.

line 26, delete "applying" before "a", insert --providing a magnetic force for retaining--.

line 27, before "comprising" insert --upon the sleeve throughout the movement of the developer during the developing operation and for applying said developer,--. after "carrier", insert --,--.

Column 24, Claim 12, line 5, delete "a"

line 25, change "roller." to --roller, the transferred toner from the toner supply roller being mixed with the developer on said sleeve and being retained on said sleeve due to said magnetic force and the elimination of any scraping or stirring means from the developing apparatus.--.

Signed and Sealed this

Tenth Day of November, 1987

*Attest:*

DONALD J. QUIGG

*Attesting Officer*

*Commissioner of Patents and Trademarks*